US006987708B2

(12) United States Patent
Megner et al.

(10) Patent No.: US 6,987,708 B2
(45) Date of Patent: Jan. 17, 2006

(54) EMERGENCY CALL TRANSMITTER INCORPORATED IN A WRISTWATCH

(75) Inventors: Günter Megner, Uhldingen (DE); Arno Hohmann, Schramberg (DE)

(73) Assignee: Junghans Uhren GmbH, Schramberg (DE)

( * ) Notice: Subject to any disclaimer, the term of this patent is extended or adjusted under 35 U.S.C. 154(b) by 222 days.

(21) Appl. No.: 10/435,376

(22) Filed: May 12, 2003

(65) Prior Publication Data

US 2003/0227829 A1 Dec. 11, 2003

Related U.S. Application Data

(63) Continuation-in-part of application No. PCT/EP01/12959, filed on Nov. 9, 2001.

(30) Foreign Application Priority Data

Nov. 11, 2000 (DE) ..... 100 55 995

(51) Int. Cl.

| | |
|---|---|
| ***G04B 47/00*** | (2006.01) |
| ***G04B 37/00*** | (2006.01) |
| ***G08B 23/00*** | (2006.01) |

(52) U.S. Cl. ..... 368/10; 368/278; 340/539.11; 340/573.1

(58) Field of Classification Search ..... 368/10, 368/47, 88, 276, 278, 281, 309–310; 340/539.11, 340/573.1

See application file for complete search history.

(56) References Cited

U.S. PATENT DOCUMENTS 5,516,005 A * 5/1996 Moseley ..... 222/3
5,617,074 A * 4/1997 White ..... 340/573.4
5,854,773 A * 12/1998 Lee ..... 368/10

FOREIGN PATENT DOCUMENTS

| | | |
|---|---|---|
| CH | 673 748 | 4/1990 |
| DE | 298 13 505 | 9/1999 |
| DE | 299 20 616 | 5/2000 |
| FR | 1 359 524 | 3/1964 |
| FR | 2 692 706 | 12/1993 |
| WO | WO 91/17542 | 11/1991 |

* cited by examiner

*Primary Examiner*—Vit W. Miska
(74) *Attorney, Agent, or Firm*—Burns, Doane, Swecker & Mathis, LLP

(57) ABSTRACT

A wristwatch is converted into an emergency call device by unscrewing a rear cover from the back of the wristwatch housing and screwing in a transmitter housing that carries a signal-emitting mechanism.

10 Claims, 2 Drawing Sheets

EMERGENCY CALL TRANSMITTER INCORPORATED IN A WRISTWATCH

This application is a continuation-in-part of International Application No. PCT/EP01/12959 filed on Nov. 9, 2001, the entire content of which is hereby incorporated by reference.

BACKGROUND OF THE INVENTION

The invention relates to a housing for an emergency call transmitter adapted to be mounted in a wristwatch.

Studies have shown that approximately 90 percent of injured persons of an aircraft crash survived the following six hours. Their chance of survival lies only at 10 percent after two days. Similar numbers apply also to travel by ship. Based on this fact, so-called ELT's (emergency locator transmitters) have been employed already for years for air travel that transmit signals for locating in the 121.5 MHZ or 243 MHZ band in case of emergency. These are relatively high-powered apparatuses mounted in the aircraft because of the large size related thereto.

In the year of 1979, the United States of America, the Soviet Union, Canada and France determined to develop and operate a satellite-aided locating system for emergency call transmitters the so-called COSPAS-SARSAT System (COSPAS is Russian for "Space System for the Search of Vessels in Distress"—SARSAT stands for "Search and Rescue Satellite-aided Tracking").

COSPAS-SARSAT has since proven that worldwide, full-area monitoring for the location of emergency call transmitters causes considerable faster rescue. Low-flying satellites were employed thereby in a polar orbit at a height of approximately 800–1,000 kilometers—the so-called LEOSAR satellites (LEOSAR stands for "Low Earth Orbit Search and Rescue").

COSPAS-SARSAT had six satellites in use in 1996. Overflight of each point on the earth surface was guaranteed thereby after approximately 45–50 minutes.

Detection of position was achieved by the use of the "Doppler effect". However, inaccuracies are associated with this system.

Response to distress signals within a few minutes was not possible in most cases with the above-mentioned LOESAR satellite since approximately 45 minutes waiting time was necessary for an overflight of the satellite at the equator and approximately 25–30 minutes waiting time in the European latitudes.

The COSPAS-SARSAT System 1996. Overflight was expanded by the subsequently-described degree to eliminate both disadvantages:

1. An immediate response to distress signals is guaranteed now by three geo-stationary satellites—the so-called GEOSAR satellites (GEOSAR stands for "Geo-stationary Search and Rescue"), which are at a height of approximately 36,000 kilometers above the equator. They cover more than 80 percent of the earth surface—except for the polar caps.
2. Introduced were furthermore the transmission of exact position coordinates (e.g. by means of GPS, which stands for "Global Positioning System). Transmission is performed on the 406 MHZ band beside the individual emergency transmission code.

The GEOSAR system showed in the test phase 1996/97 a response time to distress signals of only a few minutes in more than 95 percent of the cases.

Emergency call transmitters for the COSPAS-SARSAT system are commercially available, on one hand, as devices to be permanently mounted the respective aircraft or ships—or as portable hand-held devices. The disadvantage in such systems is the fact that the currently available devices are of relatively large size based on their stability and their battery life and that they are thereby only suitable for the above-mentioned employment purposes.

Swiss Patent (CH) 673 748 discloses a housing for a high-frequency transmitter that is inserted into a part of the back cover of a wristwatch housing. This part of the back cover is designed to be pivoted outwardly by means of hinges and it can be locked in place with the aid of a screw.

French Patent (FR) 2,692,708 describes a housing of a transmitter and/or receiver unit that has ended pieces which are formed to hold the wristband of a wristwatch so that said unit is held in place against the back of the wristwatch housing.

The object of the invention was therefore to provide an emergency call transmitter which can be employed universally and which can be carried along by anyone at all times without the need of an individually fitted holding device or the like.

This object is achieved according to the invention by an emergency call transmitter having the characteristics of the characterizing part of claim 1. An advantageous embodiment and development of the invention are shown in the minor claim 5.

SUMMARY OF THE INVENTION

The essential idea of the invention is to place an emergency call transmitter of a generally known type in a housing whereby said transmitter is designed in the shape of the back cover of a traditional wristwatch. It is proposed to use said transmitter housing in place of the fitted back cover that is found traditionally on the back of the watch housing. The transmitter housing is to be provided only with a fastening device that is designed in the way of a flange system as it exists in conventional wristwatches.

In this way, it is possible to equip any person with an emergency call transmitter so that a person does not have to carry a transmitter attached to a piece of clothing or the like. Moreover, it is also possible to take the wristwatch along without the emergency call transmitter. In this case, the transmitter housing is simply removed from the back of the watch housing and it is then replaced by the back cover. This also makes sense especially when an emergency is not to be anticipated or during the time while its transmitter is made functional again with a new energy source.

This can be realized in the simplest manner in that a wristwatch housing is used having a traditional threaded back cover so that the transmitter housing can be screwed by means of matching threads into the inner threads of the back of the watch housing, replacing the back cover. As alternatives are conceivable, among others, the embodiment examples illustrated in detail in the following drawings and subsequently described.

The emergency call transmitter practically sends a coded emergency call signal designated for its carrier, which is preferably at a frequency that can be received by a commercial satellite emergency call system and which can be transferred to an emergency call center and possibly enhanced by position data from a relay station. According to a development of the invention, the transmitter housing is equipped with a break switch that can be actuated manually for transmission function aside of the operating switch, which is actuated during extraction of an antenna wire to limit energy consumption to chronological and local circumstances during which satellite contact is to be expected—which means to considerably increase the usable operational time of the emergency call transmitter.

BRIEF DESCRIPTION OF DRAWING

Alternatives and further developments as well as additional characteristics and advantages of the invention are shown as the inventive solution in the following description of the drawing with the limitation of essentially greatly abstracted realization examples that are not drawn to scale, wherein.

DESCRIPTION OF PREFERRED EMBODIMENTS OF THE INVENTION

Figure 1:
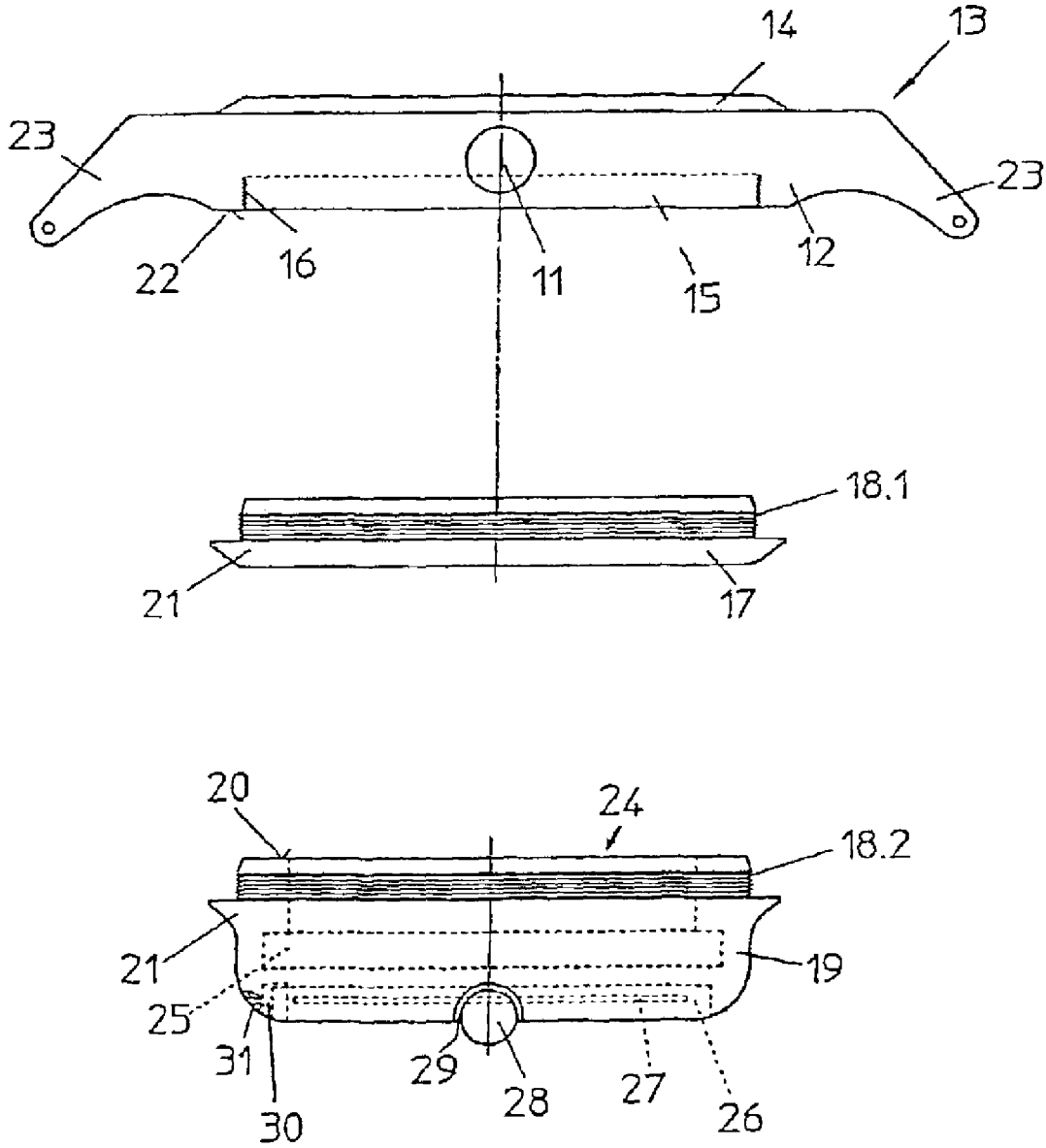
FIG. 1 shows a first embodiment of a housing according to the invention for an emergency call transmitter as replacement part for a back cover of a traditional, commercially available wristwatch—the arrangement is shown in cross section in an exploded view.

FIG. 1 of the drawings shows in a side view a watch housing 12 of a wristwatch 13 with a threaded back cover 17 removed from the back whereby said back cover may be replaced with a transmitter housing 19 according to the invention.

The watch housing 12 of a wristwatch 13, sketched in the drawing in a side view facing its crown 11, is equipped with at least one time scale under its crystal 14, such as a classic pilot watch having indicators of a chronograph. The drawing shows a concentric opening 15 with inner threads 16 opposite the crystal 14 into which an essentially flat cylindrical back cover 17 can be screwed into axially projecting outer threads 18.1 in a generally know manner.

The wristwatch 13 can also have a bowl-shaped housing 19 in place of said back cover 17, which is provided with the same low number of axially projecting, annular outer threads 18.2. Axially opposite of its free outer edge 20, the housing 19 is provided with a circumferential flange 21 projecting past the radius of the outer threads 18 similar to the back cover 17 whereby said flange 21 has upon assembly at the back 22 of the watch housing 12 a supporting and aligned transition piece leading from the relatively high housing 19 to the small horn-shaped element 23 that is part of the watch housing 12 for attachment of the two halves of a wristband (not shown here).

At the inside of the bowl-shaped housing 19 there is arranged an energy source 24 to power the emergency call transmitter 25 independently from the operation of the watch movement in the watch housing 12 and a winding device 26 for an antenna wire 27 that is wound up at first. Said wire can be manually extracted from the housing 19 by means of a pull-button 28. For this purpose, the pull-button 29 protrudes slightly from a recess 29 for easy grasping whereby said recess is positioned transverse to the orientation of the horn-shaped element 23—23 and under the crown 11 on the housing 19 of the emergency call transmitter 25.

An operating switch 30 is closed through simple centrifugal force or lever kinematics during manual extraction of the antenna wire 27 to turn on the transmitter and to send thereby an emergency signal via the antenna wire 27. Alternatively, the switch can be closed in the manner described in the afore-mentioned document FR-2,692,708, the disclosure of which is incorporated by reference herein. This signal is coded, which identifies the transmitter 25 and thus the carrier of the so equipped wristwatch. The carrier frequency of the emergency call transmitter 25 lies preferably in the 406 MHZ band to be picked up by the commercial COSPAS-SARSAT satellite emergency call system serving as relay station to be linked with location information to be further transmitted to an emergency center.

The housing 19 can be additionally equipped with a break switch 31 that can be operated manually to be able to turn off the emergency call transmitter 25 temporarily, e.g. when one cannot count momentarily on a satellite contact based on topographic or chronological circumstances—or not to reveal one's own position in a situation of threat. Said break switch 31 can be simply a pressure switch situated electrically in series with the main operating switch 30 whereby said pressure switch may be off-set opposite the antenna pull-button and be protected against unintentional actuation by being under the horn-shaped element 23 and countersunk below the outer surface of the housing 19 where it may be actuated with a pointed object.

When the housing 19 is to be equipped with a new energy source or if no emergency call situation is to be expected, the wristwatch 13 can then be fitted with a back cover 17 in a conventional manner.

Figure 2:
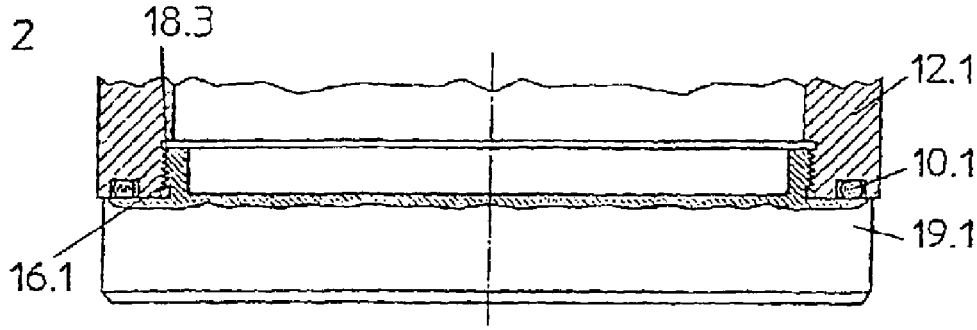
FIG. 2 shows a housing according to the invention of the type in the first embodiment example in cross section—a flange system in the way of a threaded back cover.

FIG. 2 shows a housing 19.1 according to the invention, which is designed having a screw-on threaded arrangement in the above-described manner. The herein presented drawing shows a condition in which there is inserted in the housing 19.1 a back cover that is available in a commercially obtainable wristwatch. In the presently-described embodiment example there is provided a so-called threaded back cover on the wristwatch. This threaded back cover is provided on its outer circumference with outer threads that match the inner threads 16.1 existing in the watch housing 12.1. In order to be able to insert the housing 19.1 of the emergency call transmitter in place of the threaded back cover existing in the commercially obtainable wristwatch, it is proposed according to the invention that the housing 19.1 is provided with outer threads 18.3 that are identical to the threads of the back cover. Usually there is additionally provided a seal against dust, moisture or the like by means of a sealing ring 10.1 on the contact surfaces between the watch housing 12.1 and the housing 19.1.

Figure 3:
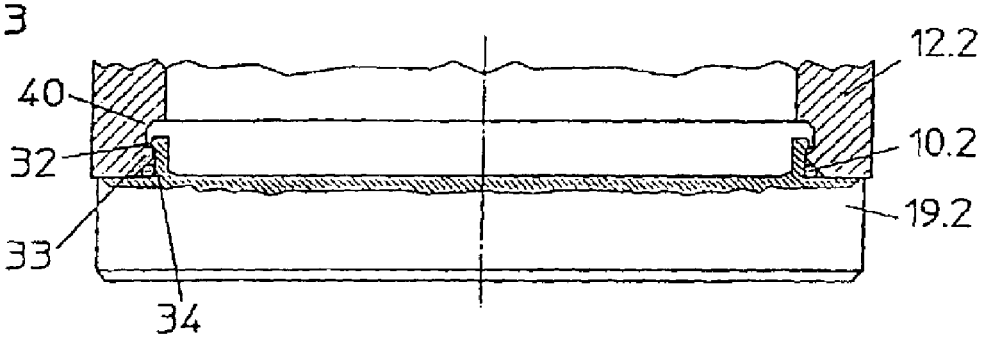
FIG. 3 shows a second embodiment example of a housing according to the invention in cross section—a flange system in the way of a pressed-on seat arrangement.

FIG. 3 shows a second embodiment example of a housing 19.2 according to the invention. It is assumed here that the so-called pressed-on back cover is a component of the commercial wristwatch whereby said back cover is held on the watch housing only by way of its tightly fitting contact surfaces. The drawing illustrates the pressed-on seat arrangement whereby the pressing edge 34 of the housing 19.2 is fitted correspondingly to the pressing edge 33 of the watch housing 12.2 through which the housing 19.2 is fixed on the watch housing 12.2 itself. In the present embodiment example, the preferably cylinder-shaped pressing edge 34 of the housing 19.2 is provided here at its face with a locking projection 32 that is designed pointing radial outward and running circumferentially, and which engages here the matching circumferentially running recess 40. There is again a sealing ring 10.2 provided to prevent entering of dust or moisture whereby said sealing ring is arranged between the corresponding contact surfaces of the watch housing 12.2 and the housing 19.2 for the emergency call transmitter.

Figure 4:
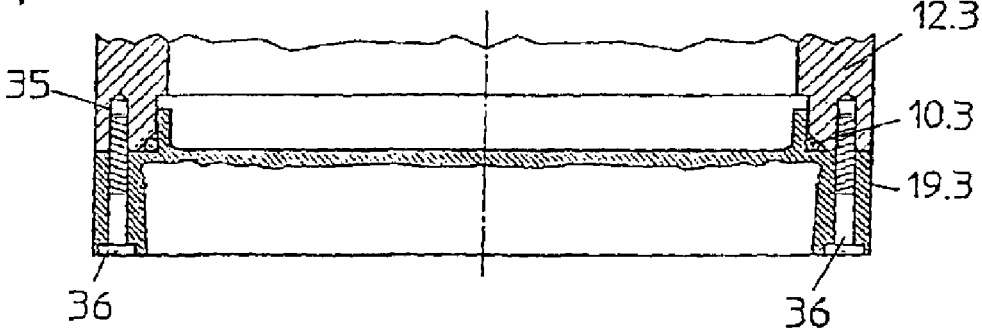
FIG. 4 shows a third embodiment example of a housing according to the invention in cross section—a flange system in the way of a back cover that can be screwed on (attached with screws).

FIG. 4 shows a third embodiment example of a housing 19.3 according to the invention whereby attachment to the watch housing 12.3 is achieved by means of a screw connection. On the commercial wristwatch there are provided here threaded borings 35 on the back and the preferably circular face of the watch housing 12.3 into which corresponding screws can be screwed to attach the back cover. In the present case, the attachment of the housing 19.3 is correspondingly achieved with the aid of matching screws 36. A sealing ring 10.3 is here also provided according to the description above.

Figure 5:
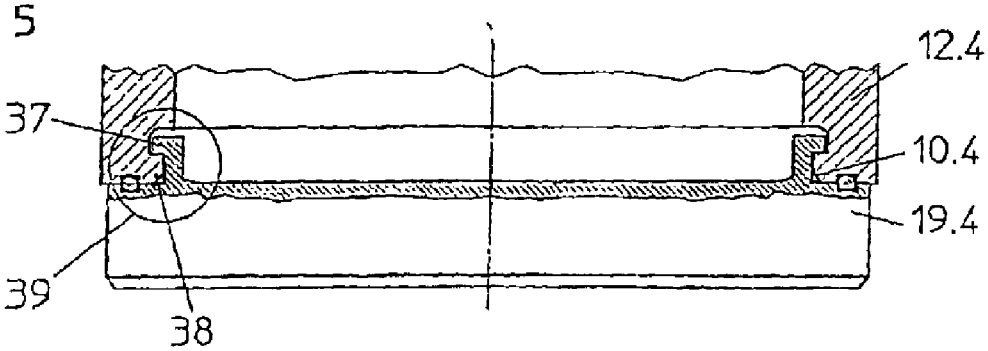
FIG. 5 shows a fourth embodiment example of a housing according to the invention in cross section—a flange system in the way of a bayonet lock.

FIG. 5 shows a fourth embodiment example of a housing 19.4 according to the invention having a bayonet lock 39 of generally known type at its face. Corresponding locking projections 37 on the housing 19.4 engage the recesses on the back of the watch housing 12.4—or locking projections 38 the watch housing 12.4 engage corresponding recesses on the housing 19.4. A sealing ring 10.4 is here also provided that has been described in detail above.

Although the present invention has been described in connection with preferred embodiments thereof, it will be appreciated by those skilled in the art that additions, deletions, modification, and substitutions not specifically described may be made without departing from the spirt and scope of the invention as defined in the appended claims.

What is claimed is:

1. An emergency call transmitter adapted to be attached in a threaded recess of a wristwatch housing, the call transmitter comprising a transmitter housing carrying an emergency signal-emitting mechanism, the housing having an external screw thread formed thereon.

2. The emergency call transmitter according to claim 1 wherein the signal-emitting mechanism includes an extractible antenna.

3. The emergency call transmitter according to claim 1 wherein the transmitter housing includes a radially outwardly extending flange disposed at an inner end of the screw thread.

4. In combination, a wristwatch and an emergency call transmitter, the wristwatch comprising a watch housing containing a time keeping mechanism, the emergency call transmitter comprising a transmitter housing carrying an emergency signal-emitting mechanism, the wristwatch housing including a back side with an opening having an internal screw thread; the transmitter having an external screw thread threaded into the internal thread.

5. The combination according to claim 3 wherein the signal-transmitting mechanism includes an extractible antenna.

6. The combination according to claim 4 wherein the transmitter housing includes a radially outwardly projecting flange situated at an inner end of the external screw thread.

7. A method of converting a watch to an emergency call transmitter, the watch comprising a watch housing containing a timekeeping mechanism and a rear cover removably secured in an opening formed in a back side of the watch housing, the method comprising the steps of:

A) removing the rear cover, and

B) replacing the rear cover with an emergency call transmitter comprised of a transmitter housing containing a signal-emitting mechanism, by securing the transmitter housing in the opening of the back side.

8. The method according to claim 7 wherein the rear cover includes a first connecting structure securing the cover in the opening, and the transmitter housing includes a second connecting structure substantially identical to the first connecting structure, wherein step B comprises securing the transmitter housing to the watch housing in the same manner as the rear cover had been screwed.

9. The method according to claim 7 wherein the cover has an external screw thread threadedly received in an internal screw thread of the watch housing, and the transmitter housing includes an external screw thread; step A comprising unscrewing the cover from the opening, step B comprising screwing the transmitter housing into the opening.

10. The method according to claim 9 wherein the transmitter housing includes a radially outwardly extending flange disposed at an inner end of the external screw thread, step B being performed until the flange engages the wristwatch housing.

* * * * *